US011723494B2

(12) United States Patent
Spandl et al.

(10) Patent No.: US 11,723,494 B2
(45) Date of Patent: Aug. 15, 2023

(54) DISPENSER FOR SOAP AND SANITIZER

(71) Applicant: SATELLITE INDUSTRIES, INC., Minneapolis, MN (US)

(72) Inventors: Everett A. Spandl, Dahlonega, GA (US); Kenneth V. Schomburg, Plymouth, MN (US)

(73) Assignee: Satellite Industries, Inc., Minneapolis, MN (US)

( * ) Notice: Subject to any disclaimer, the term of this patent is extended or adjusted under 35 U.S.C. 154(b) by 0 days.

(21) Appl. No.: 17/671,320

(22) Filed: Feb. 14, 2022

(65) Prior Publication Data

US 2022/0160185 A1 May 26, 2022

Related U.S. Application Data

(63) Continuation of application No. 17/084,265, filed on Oct. 29, 2020, now Pat. No. 11,253,110.

(51) Int. Cl.
*A47K 5/12* (2006.01)

(52) U.S. Cl.
CPC ..... *A47K 5/1211* (2013.01); *A47K 5/1207* (2013.01); *A47K 2201/00* (2013.01)

(58) Field of Classification Search
CPC ..... A47K 5/1211; A47K 5/1207; A47K 2201/00; A47K 5/12; A47K 5/1209
See application file for complete search history.

(56) References Cited

U.S. PATENT DOCUMENTS

| | | | | |
|---|---|---|---|---|
| 2,198,811 | A * | 4/1940 | Gabriel | A47K 5/12 222/2 |
| 4,238,056 | A | 12/1980 | Tucker et al. | |
| 5,713,492 | A * | 2/1998 | DeGennaro | A47K 5/1211 222/453 |
| 9,700,181 | B1 * | 7/2017 | Santoro | A47K 5/1207 |
| 2004/0251273 | A1 | 12/2004 | Brown et al. | |
| 2011/0101029 | A1 | 5/2011 | Lewis, II et al. | |
| 2015/0190827 | A1 | 7/2015 | Ophardt et al. | |
| 2017/0020347 | A1 * | 1/2017 | Santoro | B05B 11/0054 |

FOREIGN PATENT DOCUMENTS

WO 9534503 A1 12/1995

OTHER PUBLICATIONS

The extended European Search Report rendered by the European Patent Office for European Patent Application No. 21205183.3, dated Mar. 3, 2022, 9 pages.

* cited by examiner

*Primary Examiner* — Donnell A Long
(74) *Attorney, Agent, or Firm* — Skaar Ulbrich Macari, P.A.

(57) ABSTRACT

A dispenser for dispensing soap and sanitizer includes a back plate, a container insert removably securable to the back plate, and a cover pivotally engaged to the back plate and the container insert. The container insert includes a first side defining a first container receiving feature and a second side, opposite the first side, defining a second container receiving feature that has a different configuration or size than the first container receiving feature.

20 Claims, 19 Drawing Sheets

DISPENSER FOR SOAP AND SANITIZER

PRIORITY

This application is a continuation of U.S. patent application Ser. No. 17/084,265, filed Oct. 29, 2020, which is hereby incorporated herein by reference in its entirety.

FIELD

The present invention relates generally to dispensers for soap and sanitizer.

BACKGROUND

Dispensers for dispensing soap or sanitizer are commonly mounted to walls in restroom and in other locations where hand sanitizing is desired. Such dispensers can be manually actuated or automated to dispense a quantity of soap/sanitizer. The dispenser defines an enclosure with a container inside that holds the soap or sanitizer. The enclosure can be opened so that the container of soap or sanitizer can be replaced or refilled.

Typically, the dispenser is configured so that only one configuration and size of container can be accommodated inside of the dispenser. Thus, one cannot change the size or type of container utilized. Thus, one cannot adjust to accommodate variations of supplier availability, inventory and supply cost. Accordingly, there is continuing need to provide an improved dispenser for soap and sanitizer that can be easily adapted to a variety of containers.

SUMMARY

The present invention provides an improved dispenser for soap and sanitizer. In one example, the dispenser includes a back plate, a container insert removably securable to the back plate, and a cover pivotally engaged to the back plate and a container insert. The container insert includes a first side defining a first container receiving feature and a second side, opposite the first side, defining a second container receiving feature that has a different configuration or size than the first container receiving feature.

The first container receiving feature can comprise a channel defined inward from a side of the container insert with a rib projecting into the channel and the channel defining a detent. The container can include a pump portion and a main body portion with the pump portion being disposed in the channel of the container insert.

The back plate can define a plurality of apertures. The back plate can also include a pair of spaced-apart side walls that project forward from a plane of the back plate, and wherein each of the spaced-apart sidewalls define a guide rib on a lateral outward surfaces of the spaced-apart side walls. Each of the guide ribs can taper forwardly from the plane of the back plate so that the cover can be guided into a correct alignment as the cover is pivoted closed. An upper edge of the back plate can define a flexible flange with an engagement lip that is located to engage a corresponding engagement slot in a top surface of the cover when the cover is in a closed position.

The dispenser can also include a dispensing lever pivotally engaged with the cover. The dispensing lever pivots with respect to the cover between a neutral position and a dispensing position. The lever can comprise a pair of upwardly extending arms that include inward-facing projections. The inward-facing projections are configured to snap into corresponding receiving apertures defined on brackets projecting from an inner side of the cover.

The cover can comprise a pivot shaft that defines a pivot axis for the cover. The pivot shaft is secured in place between an engaging portion of the back plate and a lower engaging portion of the container insert when the container insert is mated with the back plate.

The back plate can include a pair of tracks that engage respective forward edges of the container insert. A pair of tongue members engage grooves defined in a side of the container insert.

The back plate can include a flexible locking flap that snaps over a back edge of a top surface of the container insert when the container insert is mated with the back plate.

The first container receiving feature can be configured to mate with a flexible container of a first size and with a refillable bottle. The second container receiving feature can be configured to mate with a flexible container of a second size that is different than the first size.

The disclosure also includes a dispenser system for dispensing soap or sanitizer. The system in one example includes a back plate, a container insert removably securable to the back plate, a container for soap or sanitizer, and a cover pivotally engaged to the back plate. The container defines a main body portion and a pump portion. The insert comprises a first side defining a first container receiving feature and a second side, opposite the first side, defining a second container receiving feature that has a different configuration or size than the first container receiving feature. The pump portion of the container is disposed in one of the first container receiving feature or the second container receiving feature.

The dispenser system can further comprise a dispensing lever pivotally engaged with the cover. The dispensing lever pivots with respect to the cover between a neutral position and a dispensing position. The dispenser lever is configured to compress the pump portion of the container as the dispensing lever pivots from the neutral position to the dispensing position.

The back plate can include a flexible locking flap that snaps over a back edge of a top surface of the container insert when the container insert is mated with the back plate.

The disclosure further includes a method of adapting a dispenser for soap or sanitizer to a plurality of different containers types or sizes. The method comprises in one example pivoting open a cover of the dispenser to access a container insert, removing the container insert that was attached to a back plate of the dispenser in a first orientation, attaching the container insert to the back plate in a second orientation that is different than the first orientation, and pivoting closed the cover until the cover latches with the back plate.

A pump portion of a container for soap or sanitizer can be inserted in a channel of the container insert.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
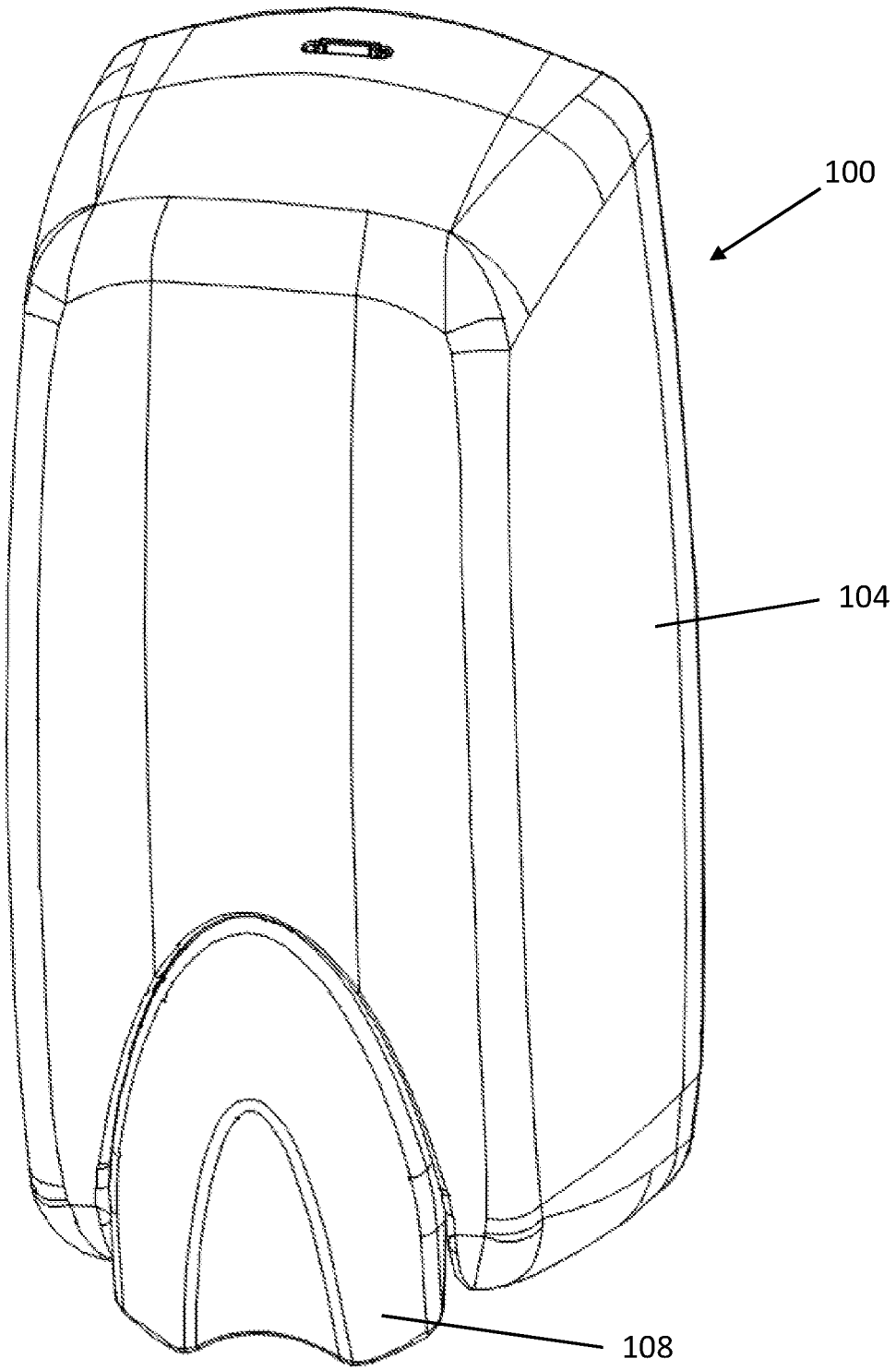
FIG. 1 is a perspective view of a dispenser for soap and sanitizer according to certain embodiments.
Figure 2:
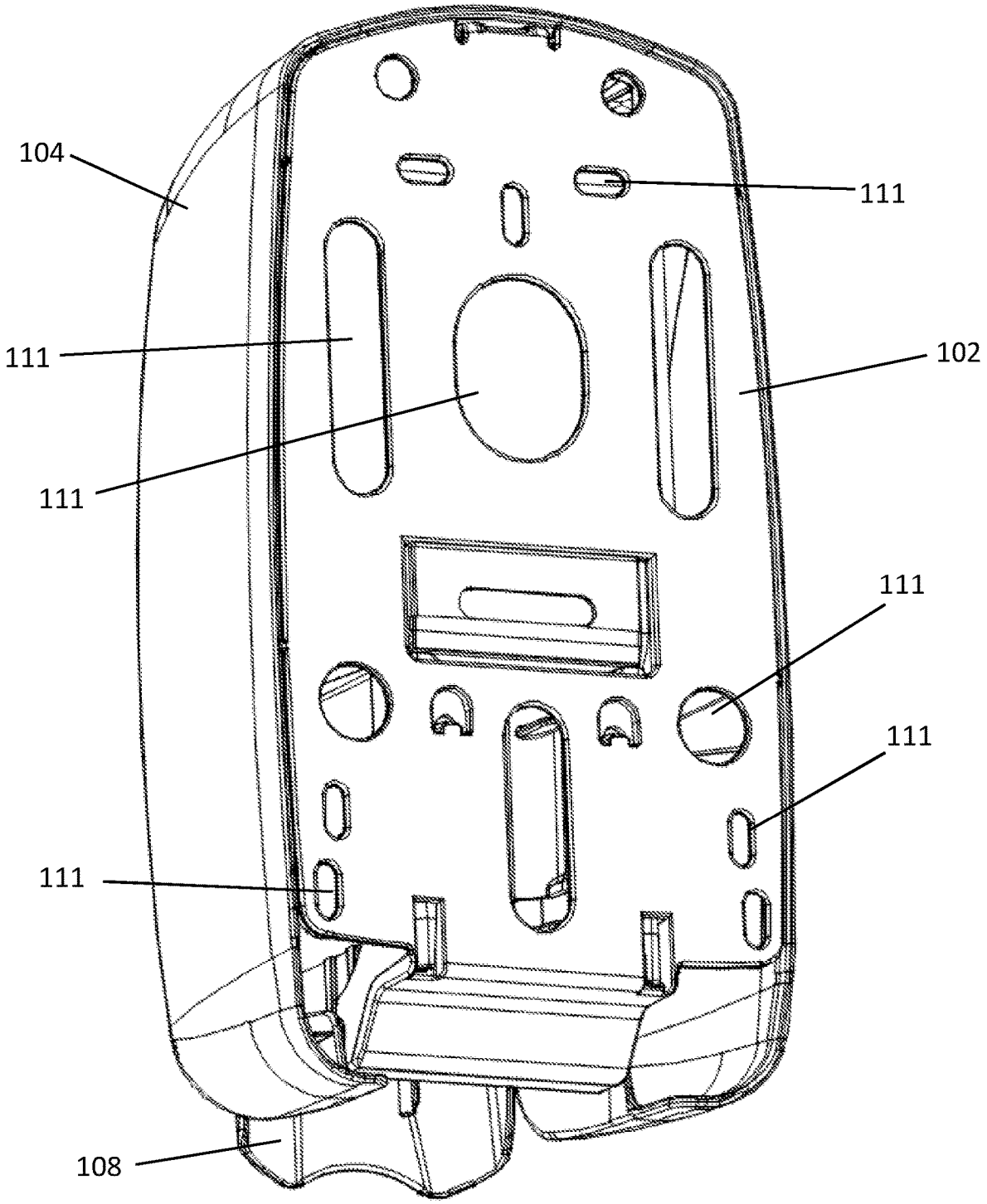
FIG. 2 is another perspective view of a dispenser for soap and sanitizer according to certain embodiments.
Figure 3:
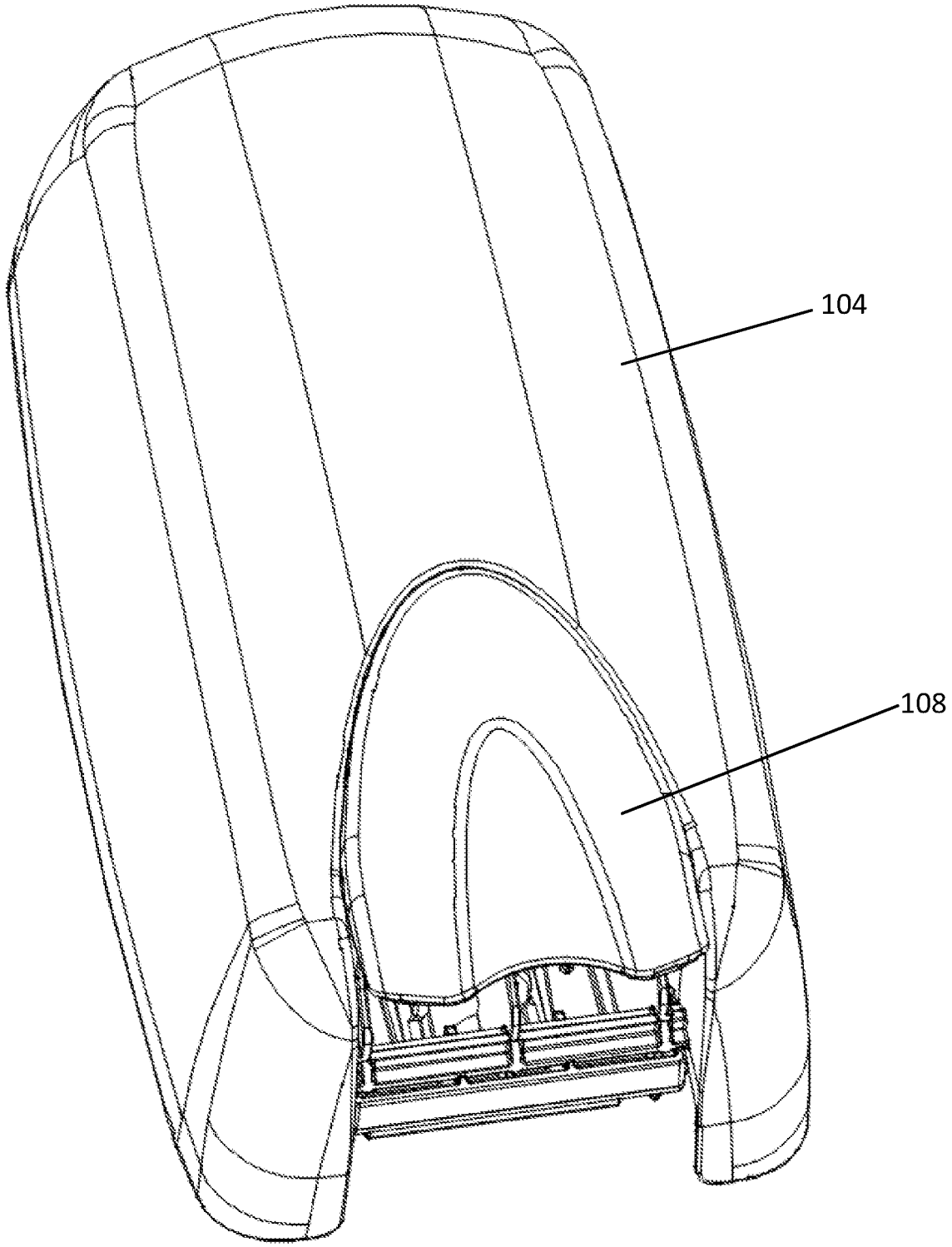
FIG. 3 is a further perspective view of a dispenser for soap and sanitizer according to certain embodiments.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various exemplary embodiments. Nevertheless, these embodiments are not intended to limit the present invention to any specific example, environment, application, or particular implementation described herein. Therefore, descriptions of these example embodiments are only provided for purpose of illustration rather than to limit the present invention.

Referring generally to FIGS. 1-21, the dispenser 100 comprises a back plate 102, a cover 104 pivotally attached to the back plate and a container insert 106 that is secured to the back plate 102. The back plate 102 and cover 104 define an enclosure. A lever is provided 108 to allow the user to manually actuate and release a quantity of soap or sanitizer from the dispenser 100.

A container 110 is disposed inside of the enclosure and is engaged with the insert 106. The container 110 can be in the form of a bag or bottle that contains a volume of sanitizer or soap. For example, the container can be an 800 mL or a 1000 mL bag, or it can be a 700 mL refillable bottle. Other sizes and types of containers can also be provided.

The back plate 102 defines a plurality of apertures 111 in the form of holes and slots. Some of these apertures 111 are located and sized to facilitate attachment of the back plate 102 to a wall or other surface with mechanical fasteners (e.g. screws). Additional apertures are provided to reduce plastic use and cost where the location, shape and size of the aperture will not degrade the performance and durability of the back plate 102. The apertures for attachment can be provided in common locations for conventional dispensers so that the dispenser according to the present invention can be retrofitted to replace a conventional dispenser without the need to create new holes in the wall.

Figure 14:
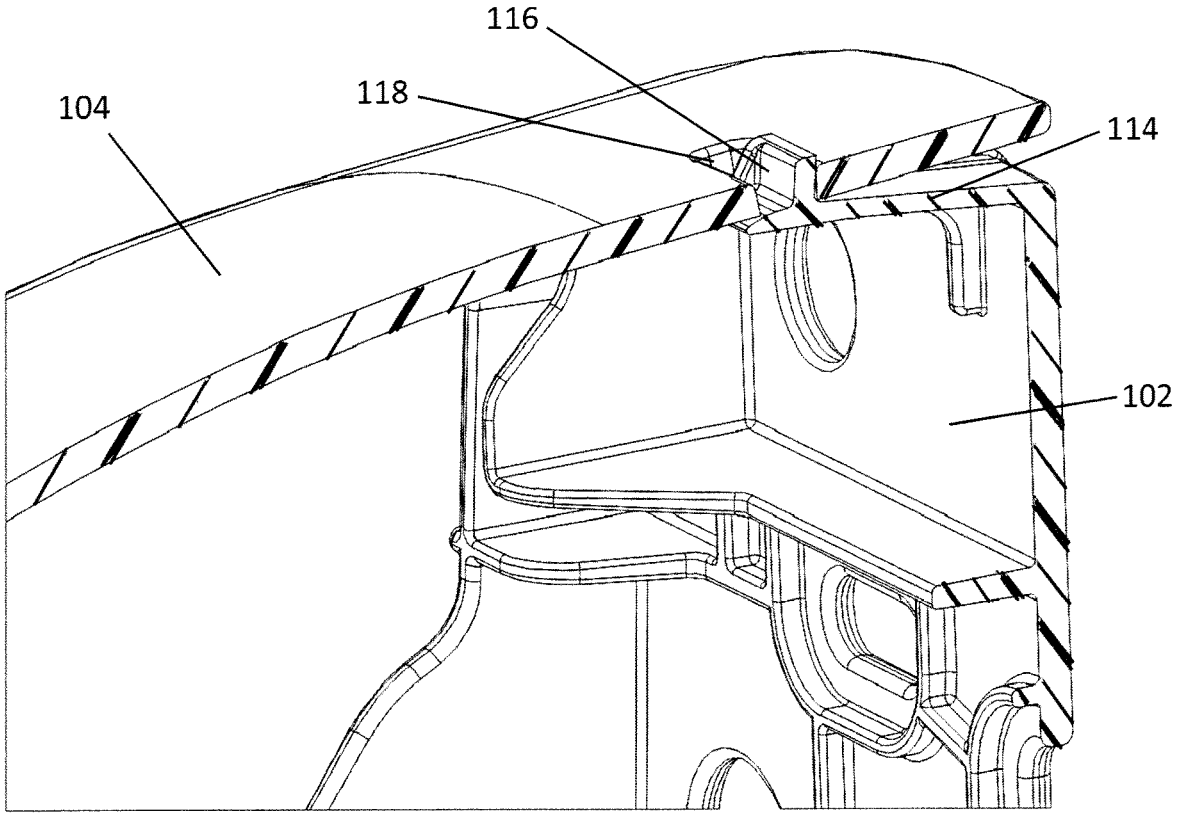
FIG. 14 is a cross-sectional perspective view of a portion of a dispenser for soap and sanitizer according to certain embodiments.

Referring particularly to FIG. 14, an upper edge of the back plate defines a flexible flange 114 with an engagement lip 116 that engages a corresponding engagement slot 118 in a top surface of the cover 104. When the cover 104 is pivoted into the closed position, the lip 116 extends or keys into the engagement slot 118 to prevent the cover from easily being pivoted open. A user can push the lip downward, for example with a flat end of a screwdriver, to disengage the lip 116 from the slot 118 so that the cover 104 can be pivoted open.

Figure 4:
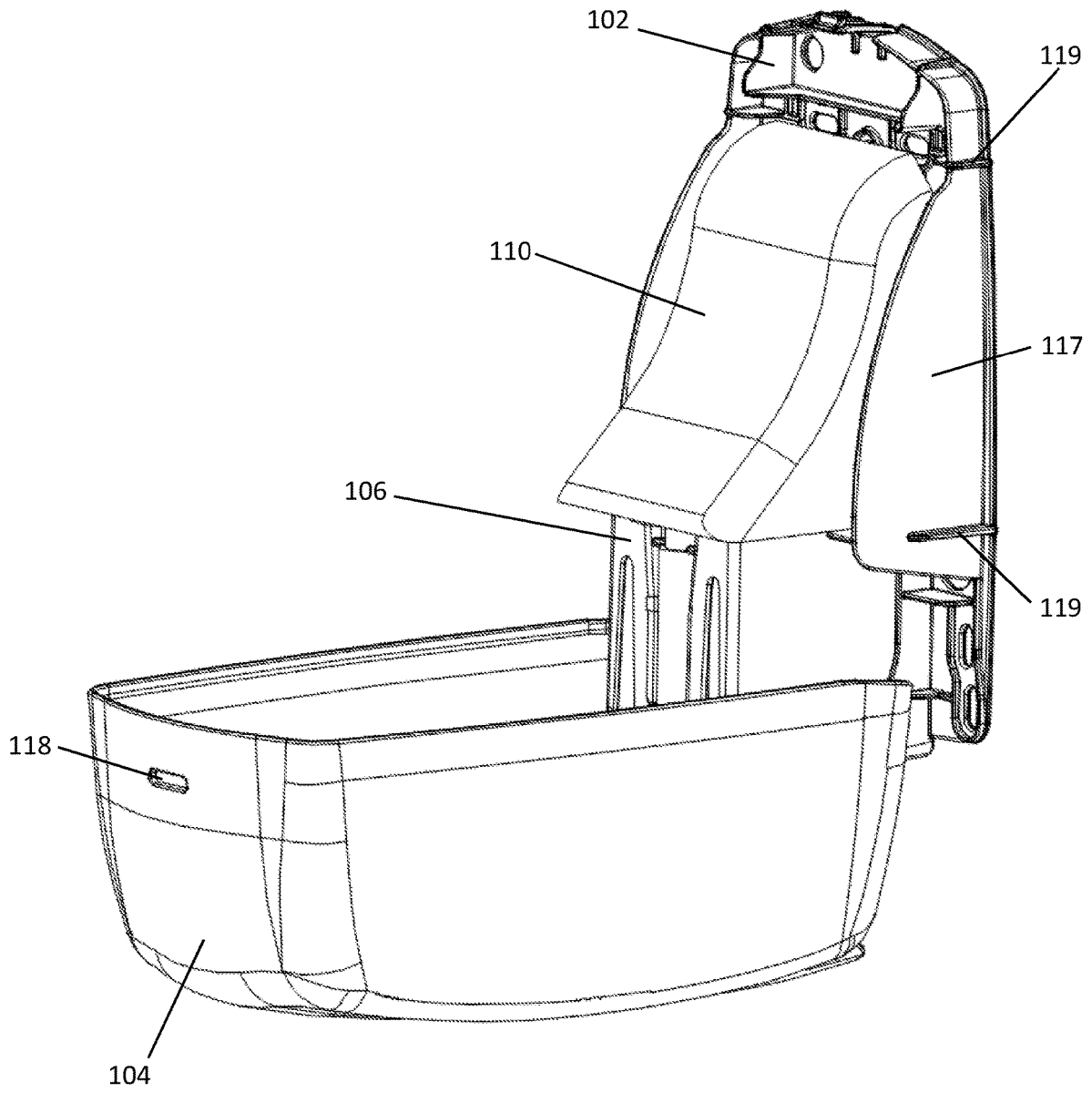
FIG. 4 is a perspective view of a dispenser for soap and sanitizer with the cover pivoted to an open position according to certain embodiments.
Figure 7:
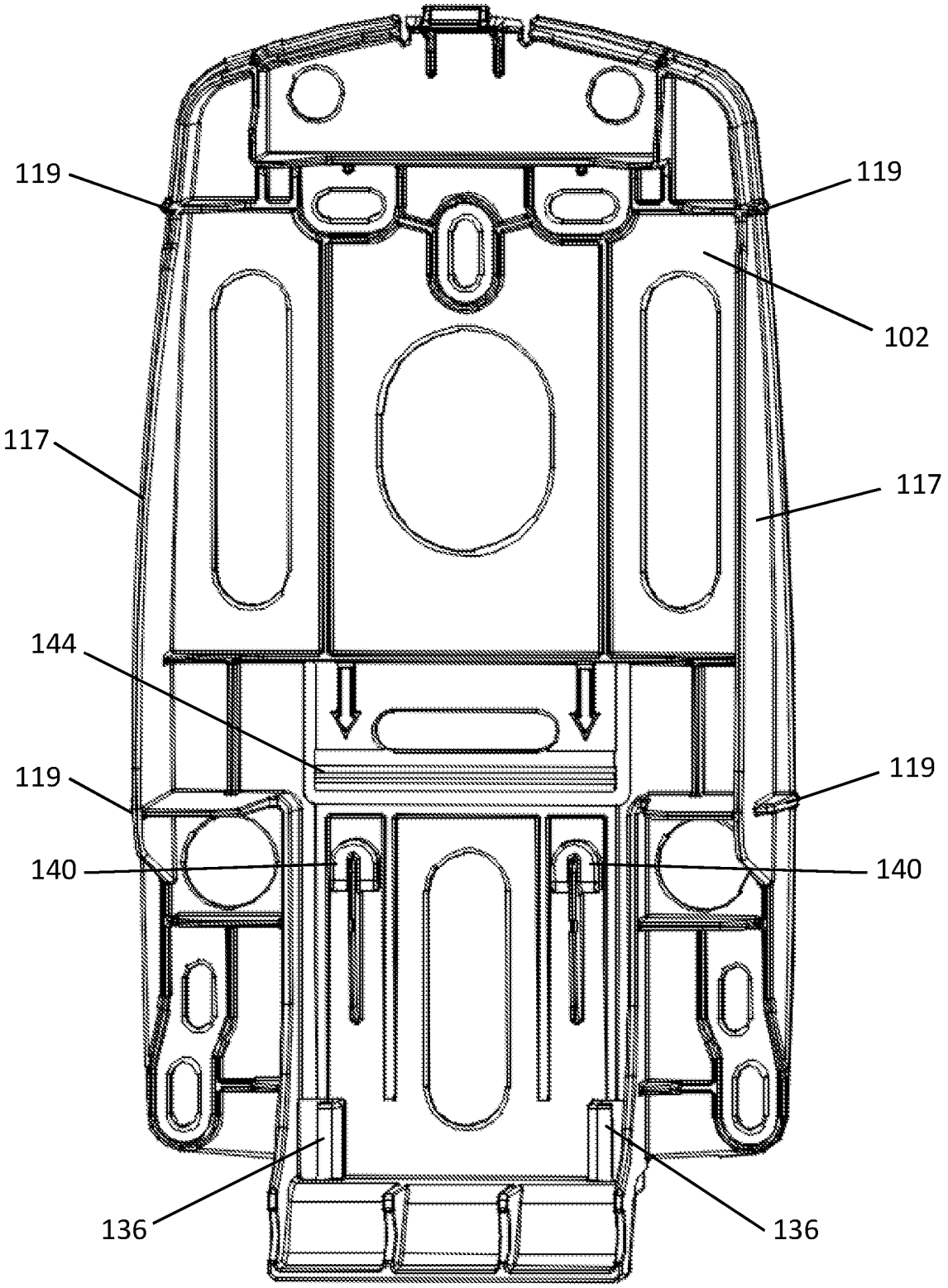
FIG. 7 is a front view of a wall-mounting plate of a dispenser for soap and sanitizer according to certain embodiments.
Figure 8:
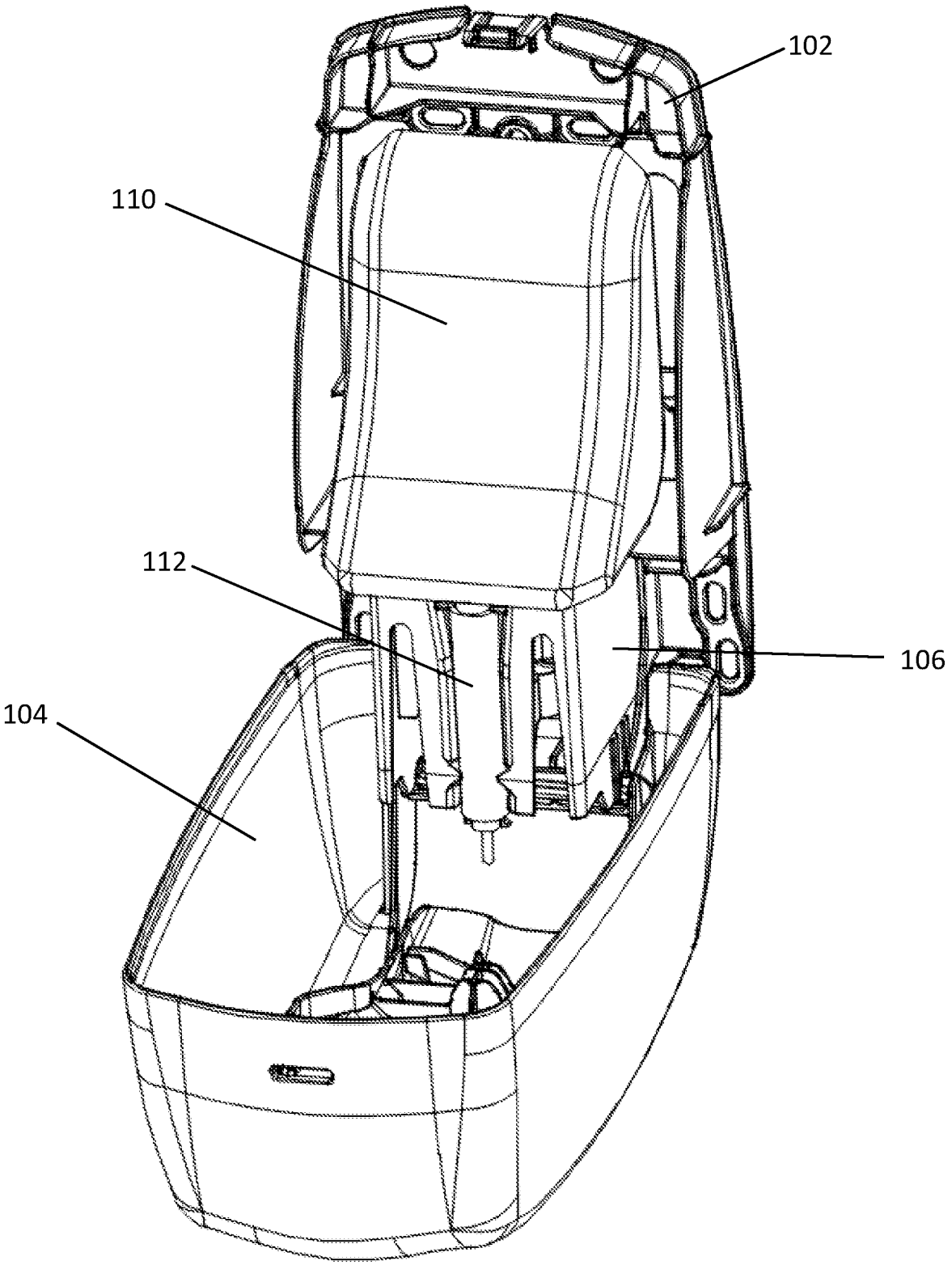
FIG. 8 is a perspective view of a dispenser for soap and sanitizer with the cover pivoted to an open position according to certain embodiments.
Figure 9:
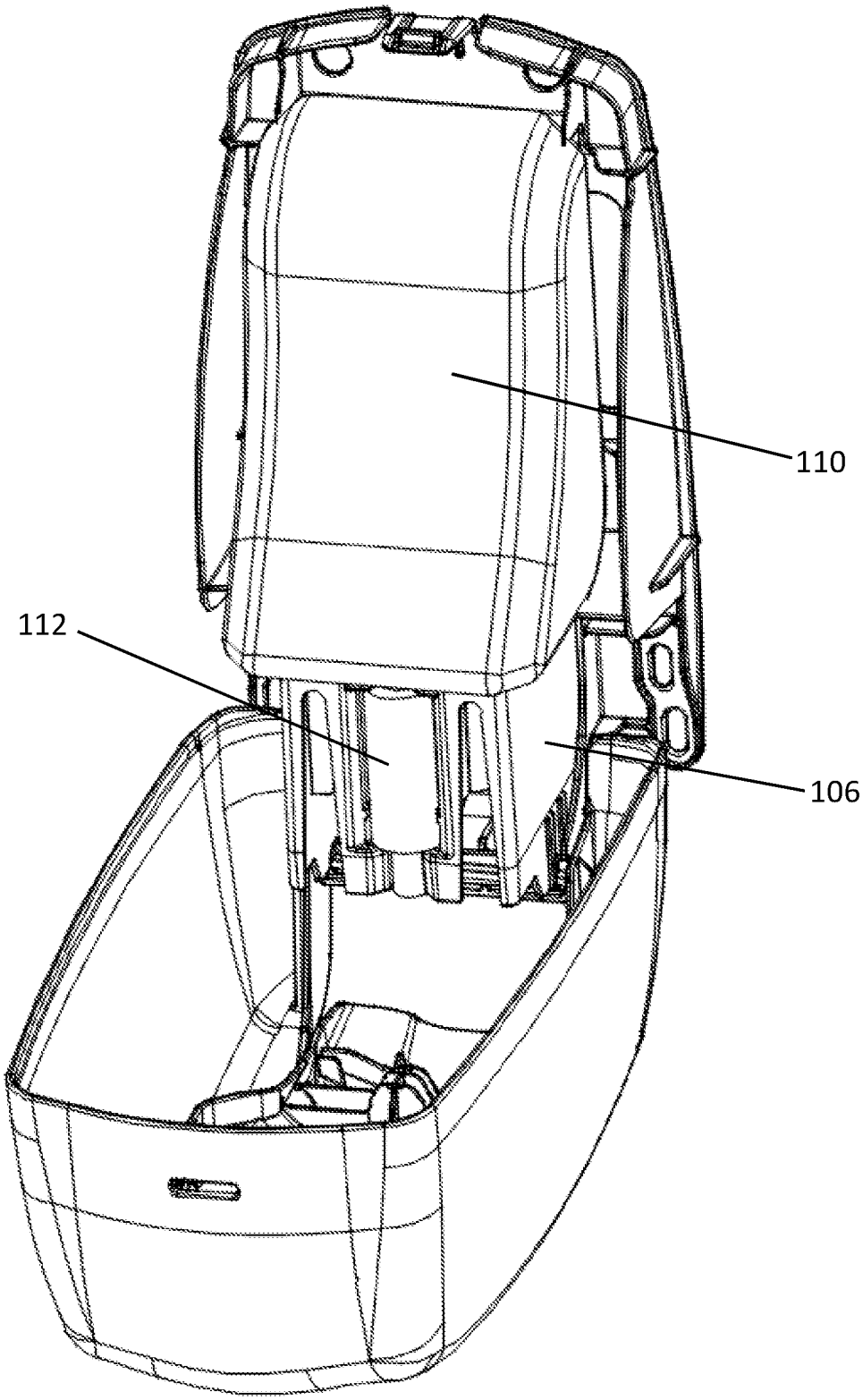
FIG. 9 is a perspective view of a dispenser for soap and sanitizer with the cover pivoted to an open position according to certain embodiments.

Referring particularly to FIGS. 4 and 7, the back plate 102 includes a pair of spaced-apart side walls 117 that project forward from the plane of the wall to which the plate is attached. Guide ribs 119 are disposed on the lateral outward surfaces of the side walls 117. The ribs 119 taper from front to back so that the cover 104 can be guided into the correct alignment as it is pivoted closed. This ensures that the lip 116 reliably keys into the engagement slot 118 even if an offset force is applied to the cover as it is closed.

Figure 11:
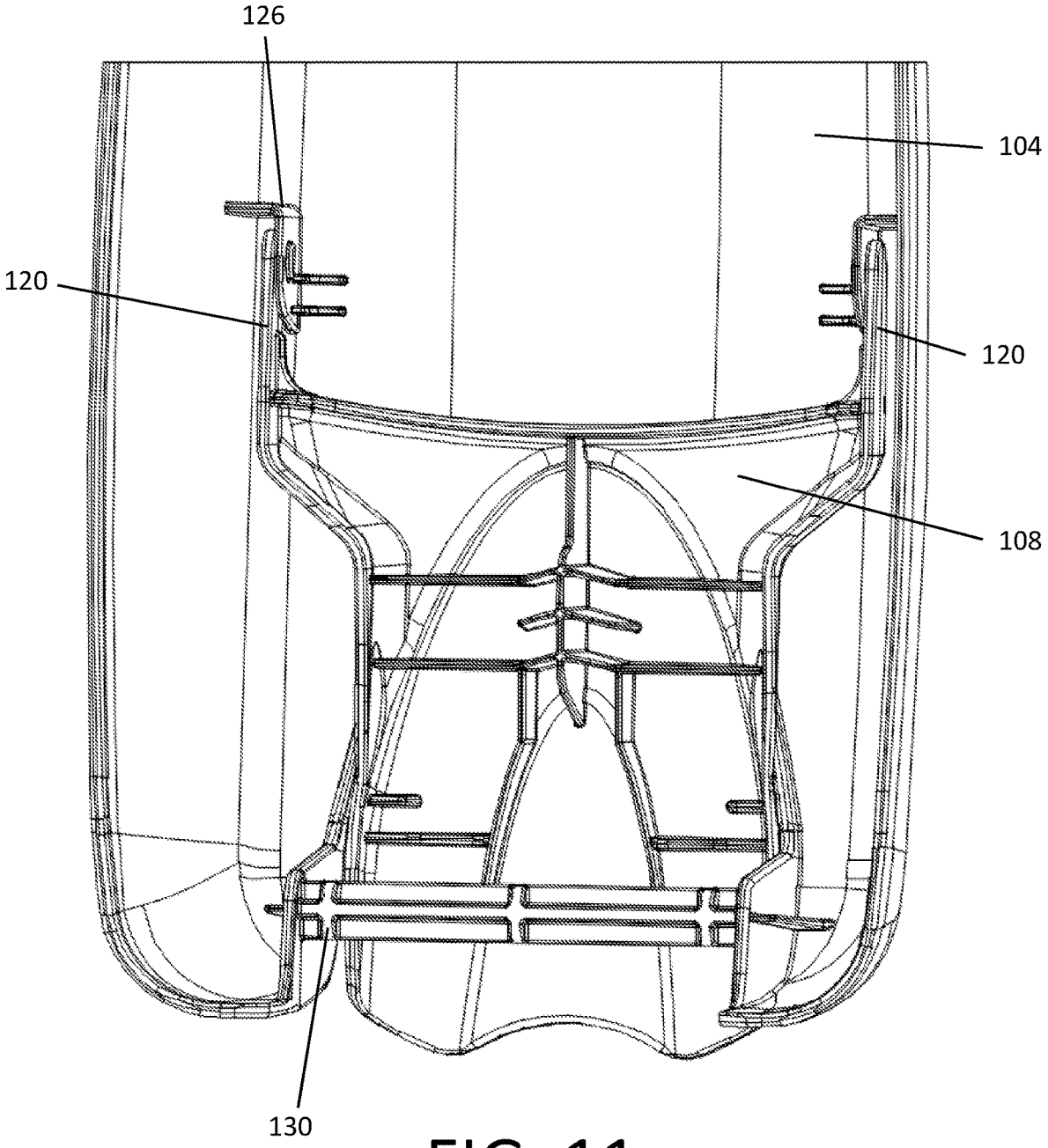
FIG. 11 is a perspective view of a portion of a cover and lever for a dispenser for soap and sanitizer according to certain embodiments.
Figure 12:
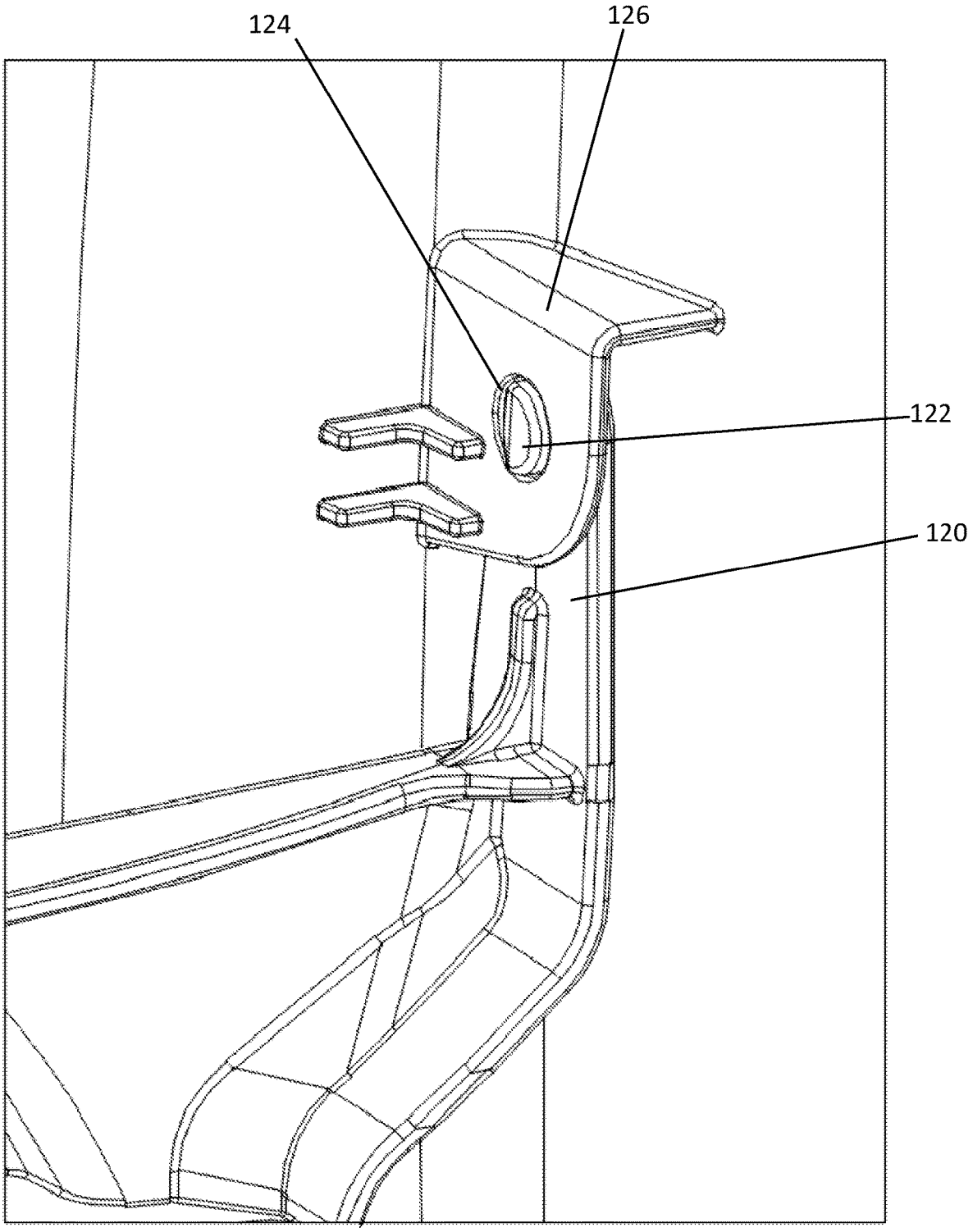
FIG. 12 is a perspective view of another portion of a cover and lever for a dispenser for soap and sanitizer according to certain embodiments.

Referring specifically to FIGS. 11-12, the lever 108 is shown pivotally engaged with the cover 104. A pair of upwardly extending arms 120 include arcuate inwardly-projections 122. These projections 122 snap into corresponding apertures 124 defined on brackets 126 of the inner side of the cover 104. The lever pivots about the projections 122 between a neutral position and a dispensing position.

Figure 5:
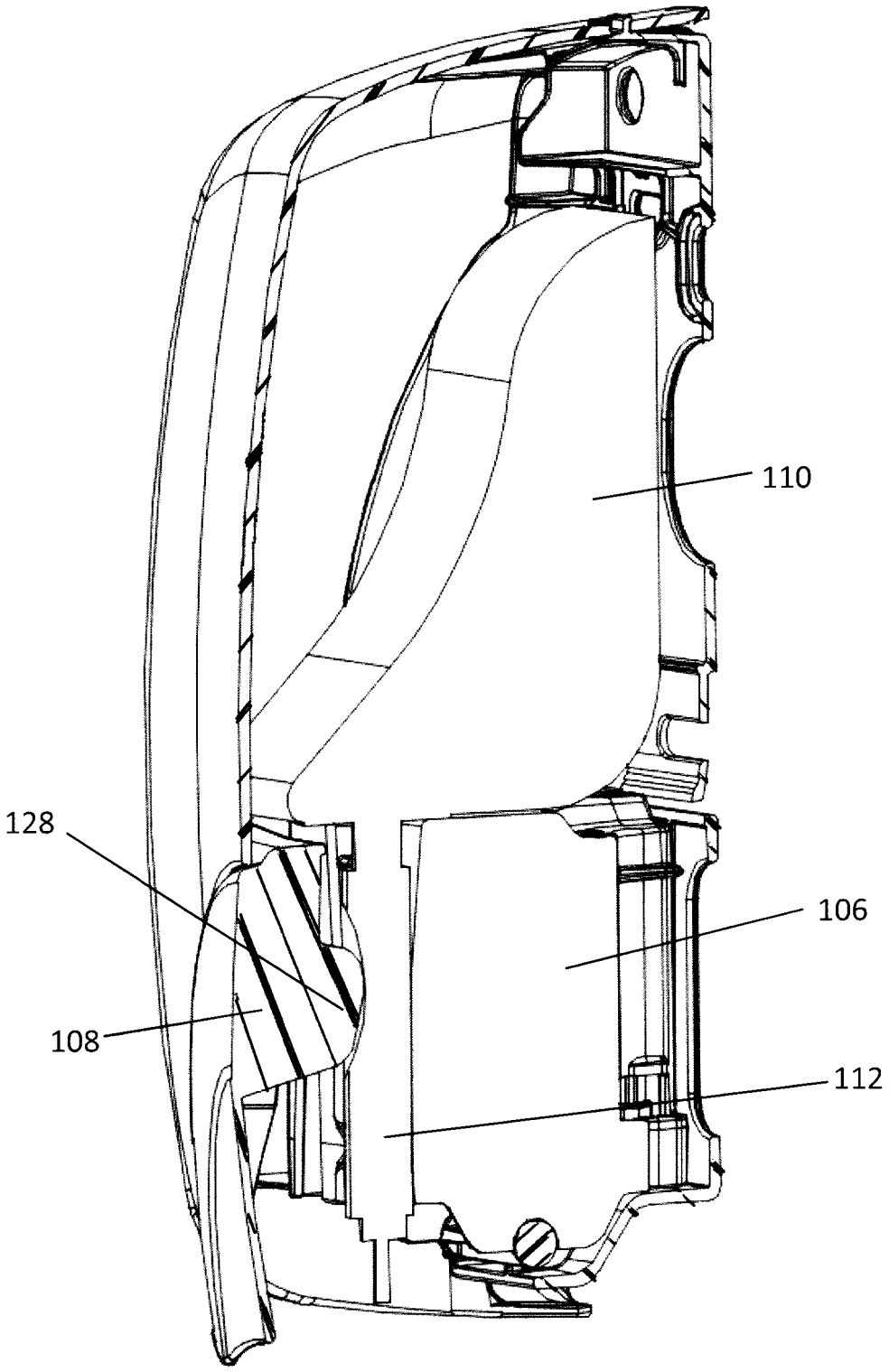
FIG. 5 is a vertical cross-sectional perspective view of a dispenser for soap and sanitizer according to certain embodiments.
Figure 6:
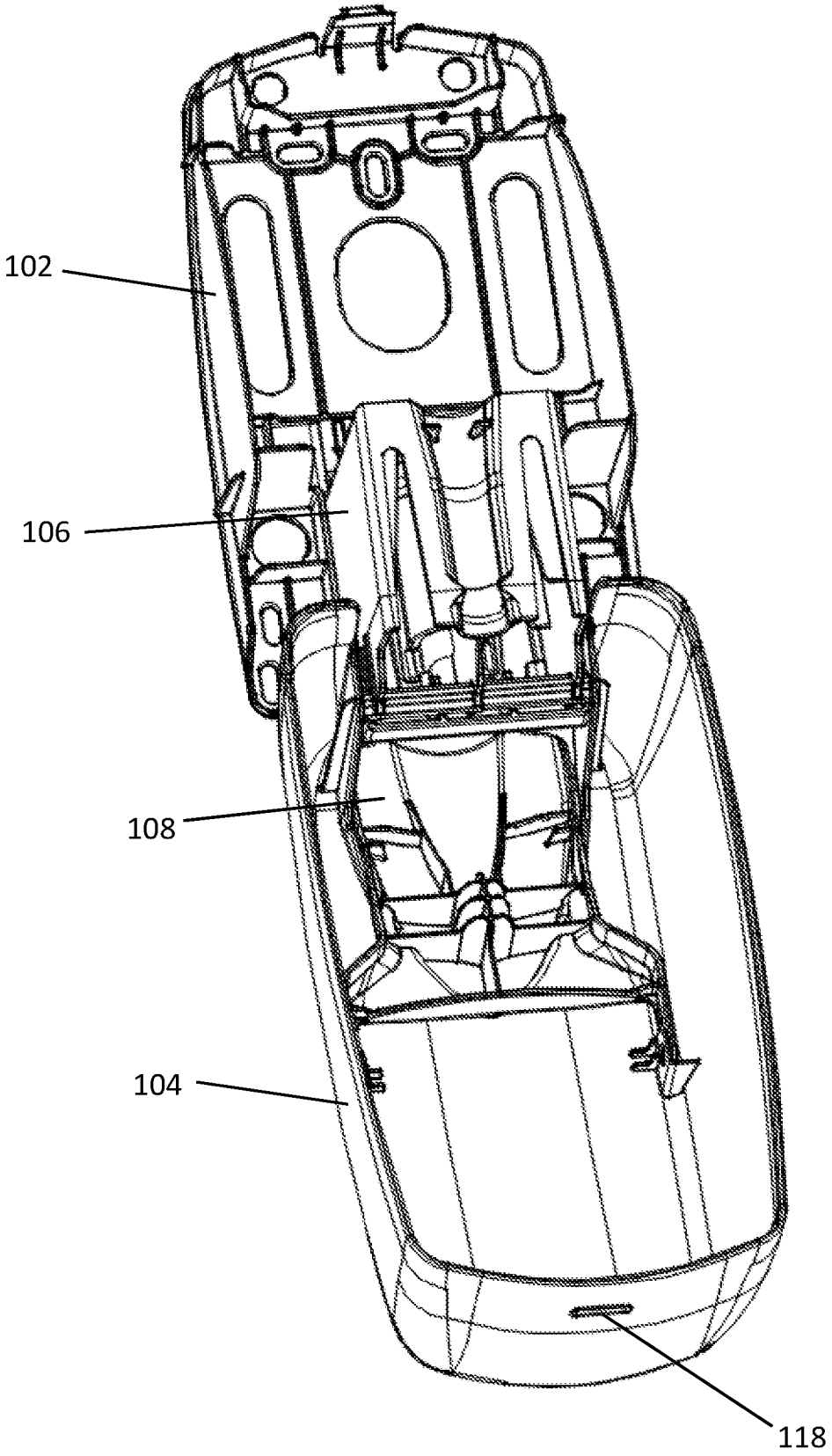
FIG. 6 is a perspective view of a dispenser for soap and sanitizer with the cover pivoted to an open position according to certain embodiments.
Figure 21:
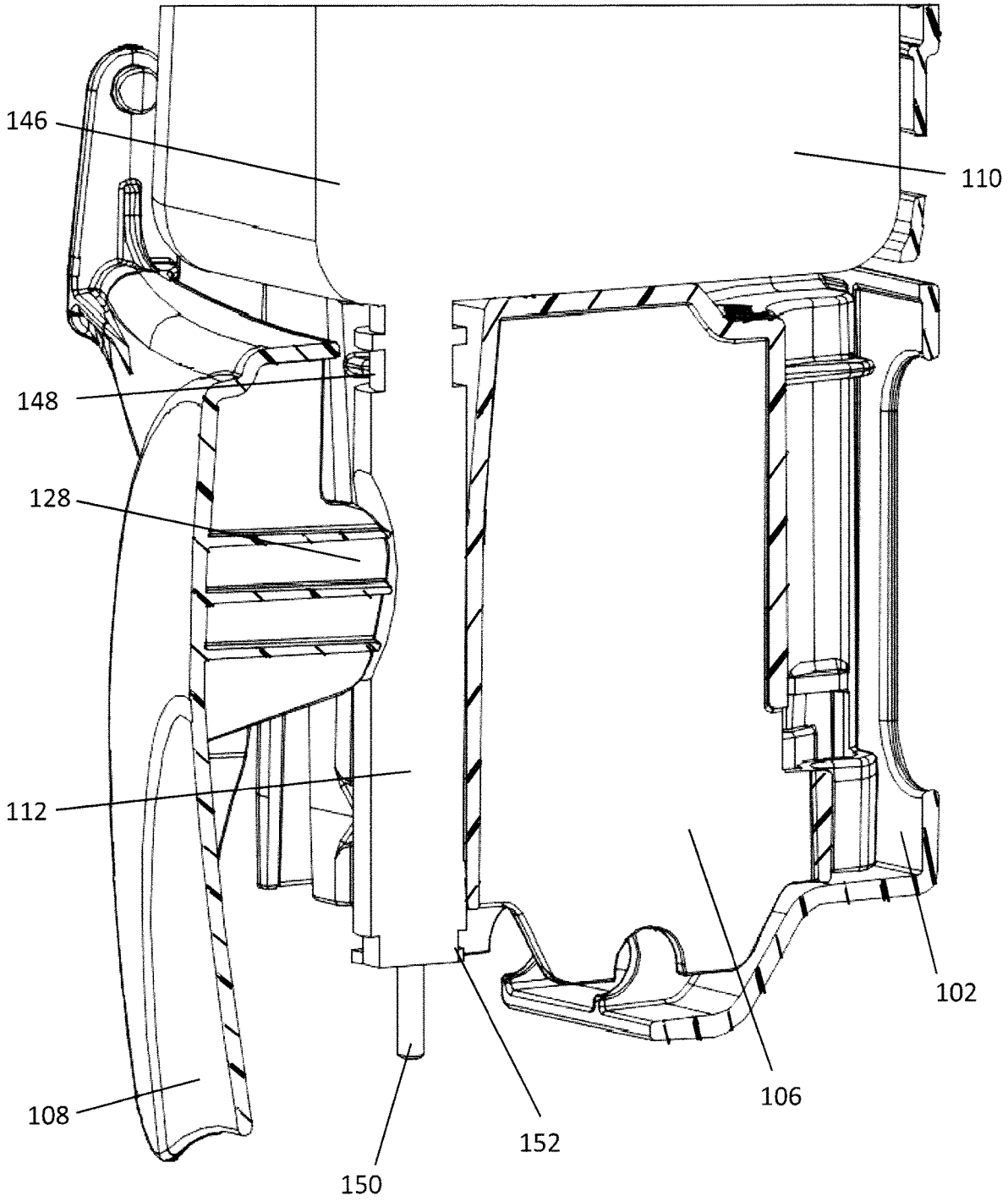
FIG. 21 is a vertical cross-section perspective view of dispenser for soap and sanitizer according to certain embodiments.

In the dispensing position, as can be seen in FIGS. 5 and 21, a backside projecting portion 128 of the lever 108 (as will be discussed below) causes container to release a quantity of the soap or sanitizer contained therein.

Figure 13:
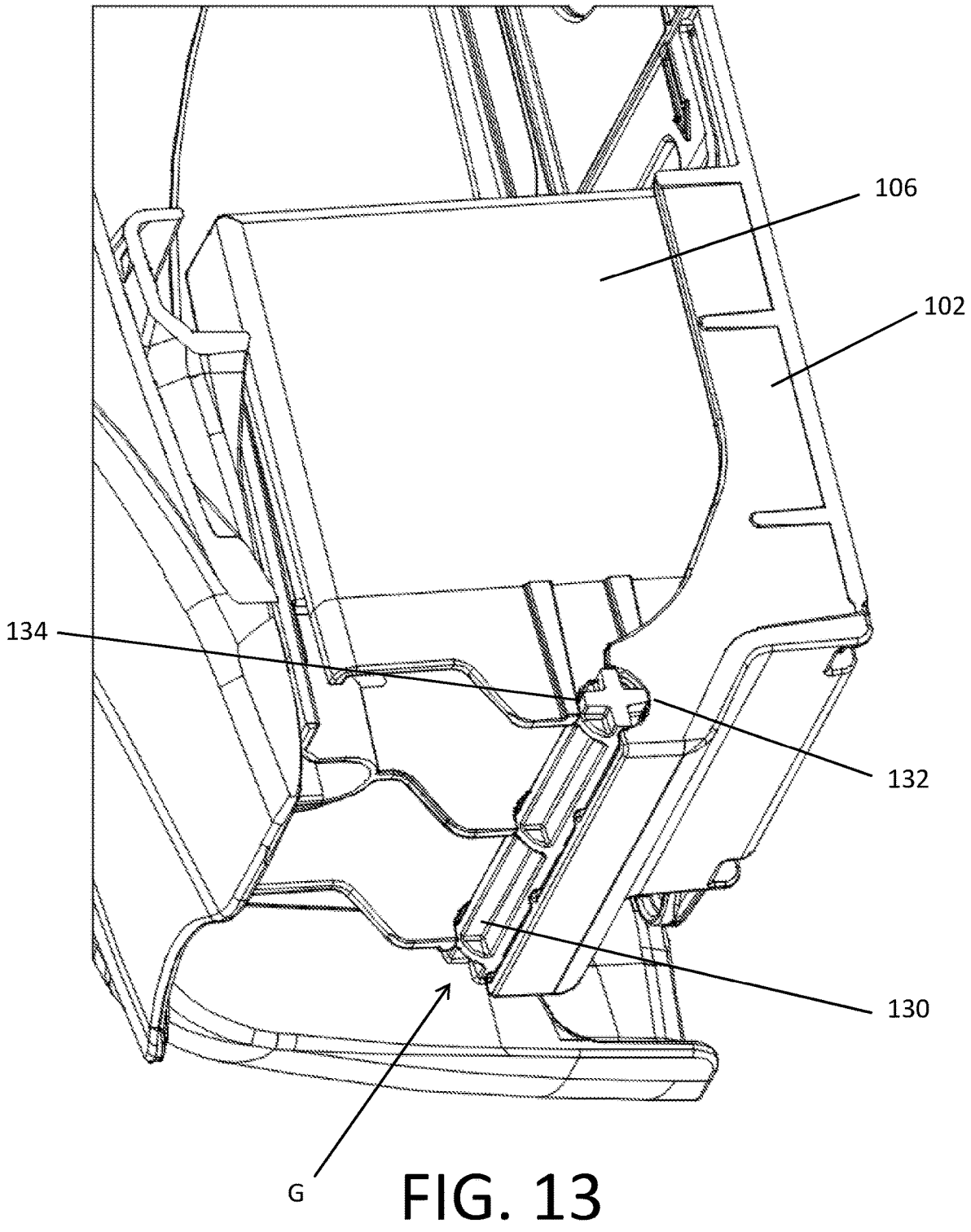
FIG. 13 is a perspective view of a dispenser for soap and sanitizer with a portion of the cover removed to show internal detail according to certain embodiments.

Referring now to FIGS. 11 and 13, the pivot shaft 130 of the cover 104 can be seen. The longitudinal axis of the pivot shaft 130 is oriented in the horizontal plane and it defines the pivot axis for the cover. As can be seen particularly in FIG. 13, the pivot shaft 130 is secured in place between an engaging portion 132 of the back plate 102 and a lower engaging portion 134 of the container insert 106. Thus, the cover is constrained to pivot about the longitudinal axis of the pivot member 130 with the container insert 106 secured to the back plate 102. Removing the container insert 106 allows the cover to be separated from the back plate 102.

A gap (G) is defined by the engaging portion 132 of the back plate 102 and the lower engaging portion 134 of the container insert 106. The gap G allows the pivot shaft to be forcibly separated from its constrained position if a force about a pre-set threshold is applied to the cover. This gap feature reduces the likelihood of the dispenser being damaged in the event that it is intentionally abused.

Figure 15:
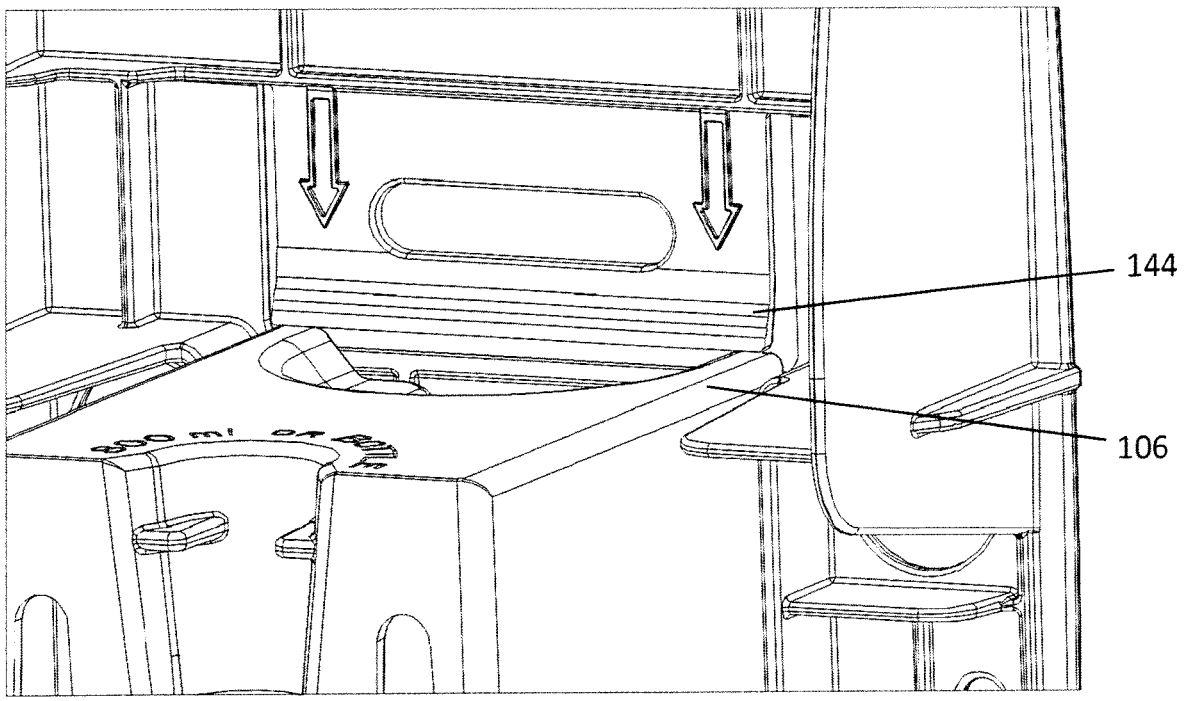
FIG. 15 is a perspective view of a portion of a wall plate and container insert for a dispenser for soap and sanitizer according to certain embodiments.
Figure 16:
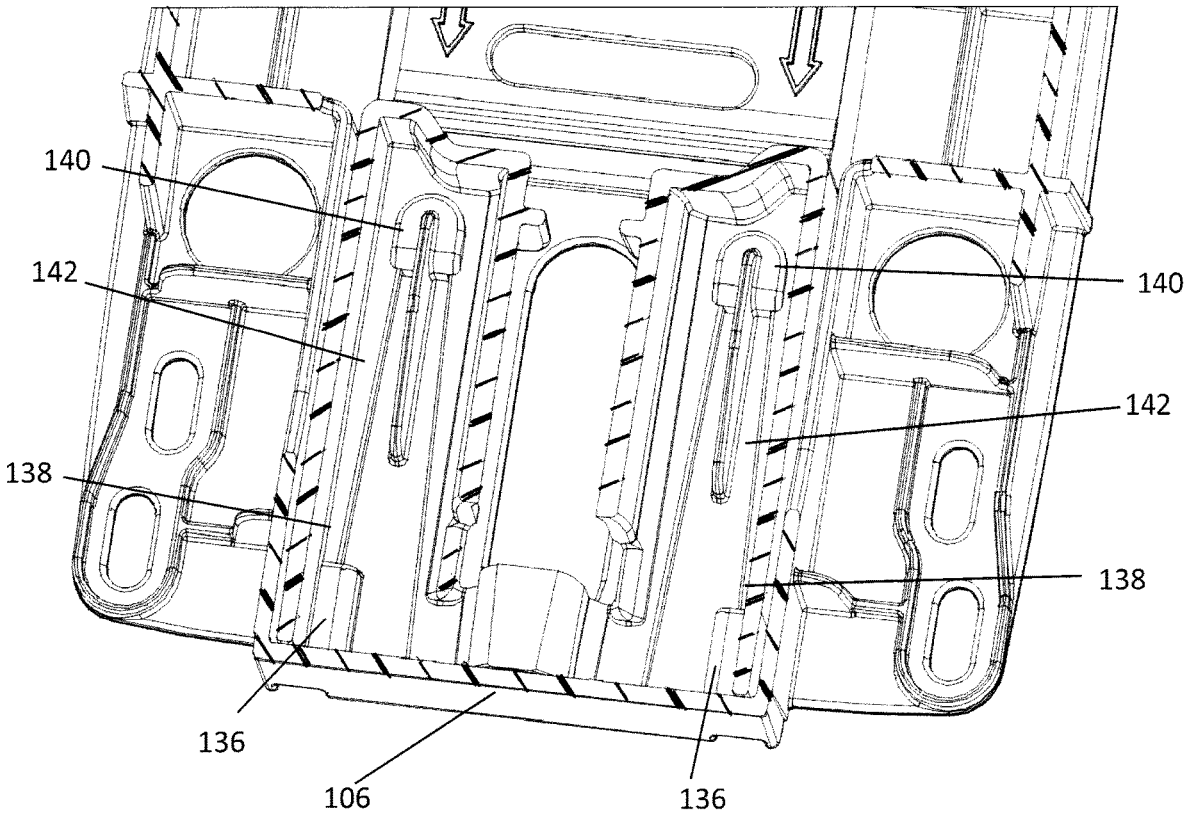
FIG. 16 is a perspective view of a portion of a wall plate and a cross-sectioned container insert for a dispenser for soap and sanitizer according to certain embodiments.

Referring in particular to FIGS. 7 and 15-16, it can be seen that the back plate 102 further comprises a locking feature for the container insert 106. The back plate defines a pair of tracks 136 that engage respective forward edges 138 of the container insert 106. A pair of tongue members 140 also engage grooves 142 defined in the sides of the container insert 106. Further, a flexible locking flap 144 snaps over the back edge of the top surface of the container insert 106 when the container insert 106 is fully seated into the tracks 136 and tongue members 140. Thus, the container insert 106 is secured in place until the user pushes the locking flap towards the wall plate to release the container insert 106, which may then be removed by an upward sliding movement relative to the back plate 102.

As can be seen in FIGS. 5 and 21, the container 110 includes a pump 112. The pump 112 can be a flexible tube extending downward from the main container body 146. The pump 112 is separated from the main container body 146 via a first check valve 148 so that when the pump 112 is compressed by the lever 108, soap or sanitizer flows out of the dispensing end 150 rather than back into the container body. A second check valve 152 is disposed at the dispensing end 150 so that when the pump 112 is relaxed after being compressed the vacuum force from inside the pump body pulls the soap or sanitizer into the pump's body from the container body 146 so that the pump 112 is ready to dispense again when the lever is pushed.

The size and shape of the pump 112 can vary across a variety of different types and sizes of containers. In effect, the container 110 with its integrated pump 112 is keyed to a particular one of a conventional dispenser configuration. This means that the conventional dispenser cannot accept a differently configured container and pump, and that a given container and pump cannot be used with conventional dispensers having an incompatible configuration. The present invention overcomes this problem with the container insert 106 that is configured for multiple different containers and that can be switched out for still further inserts with additional different configurations.

Figure 17:
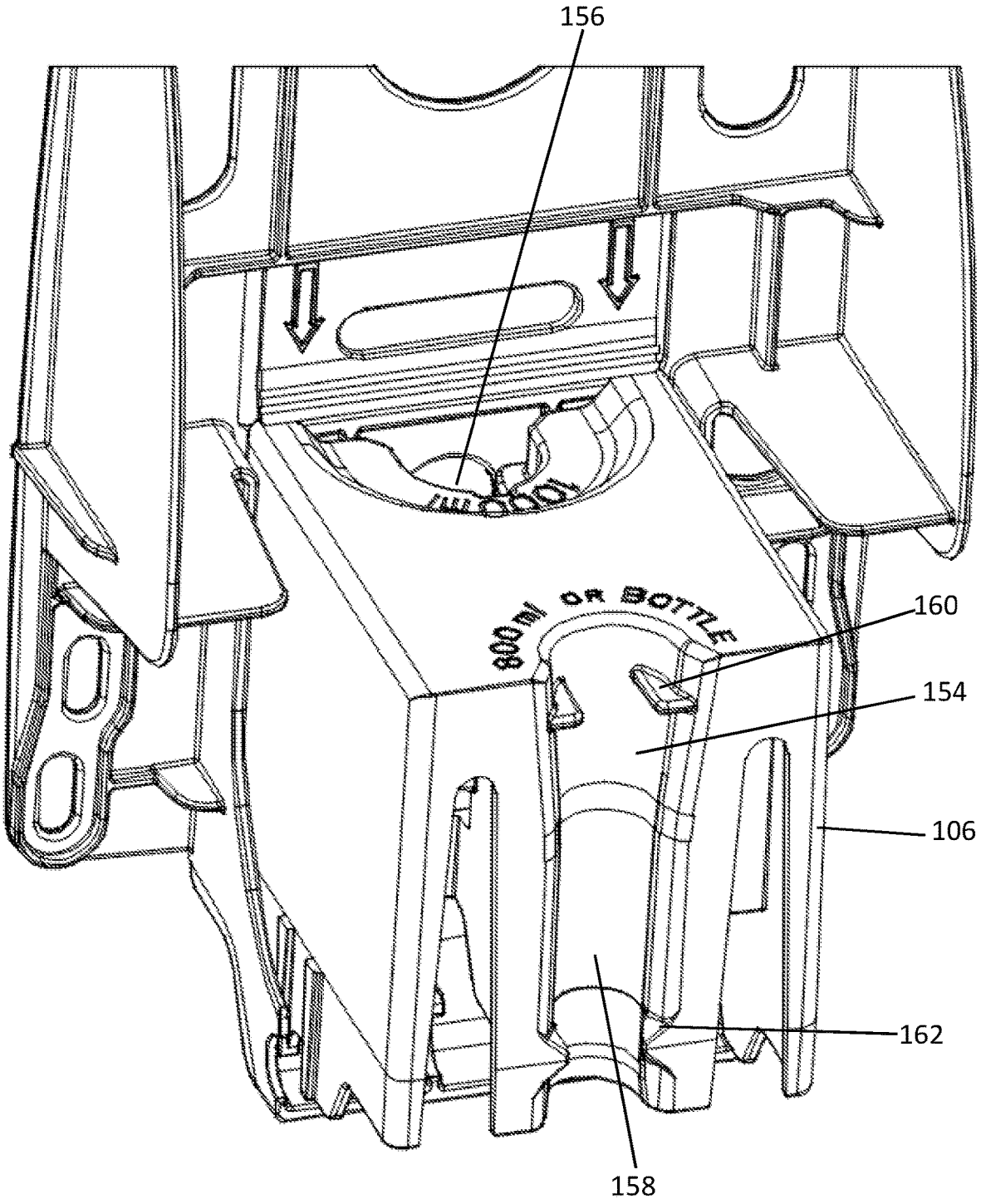
FIG. 17 is a perspective view of a portion of a wall plate and container insert for a dispenser for soap and sanitizer according to certain embodiments.
Figure 18:
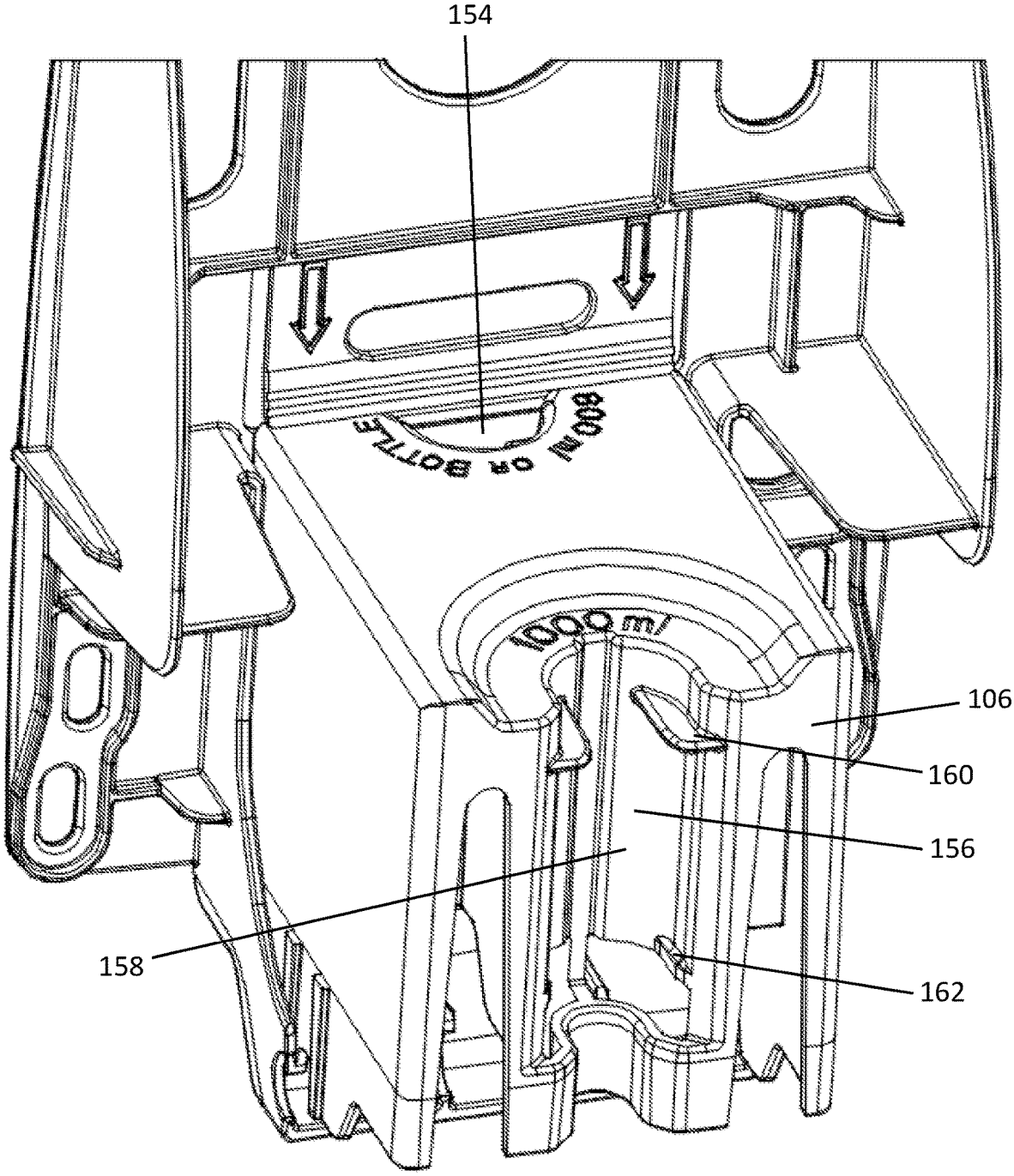
FIG. 18 is a perspective view of a portion of a wall plate and container insert for a dispenser for soap and sanitizer according to certain embodiments.
Figure 19:
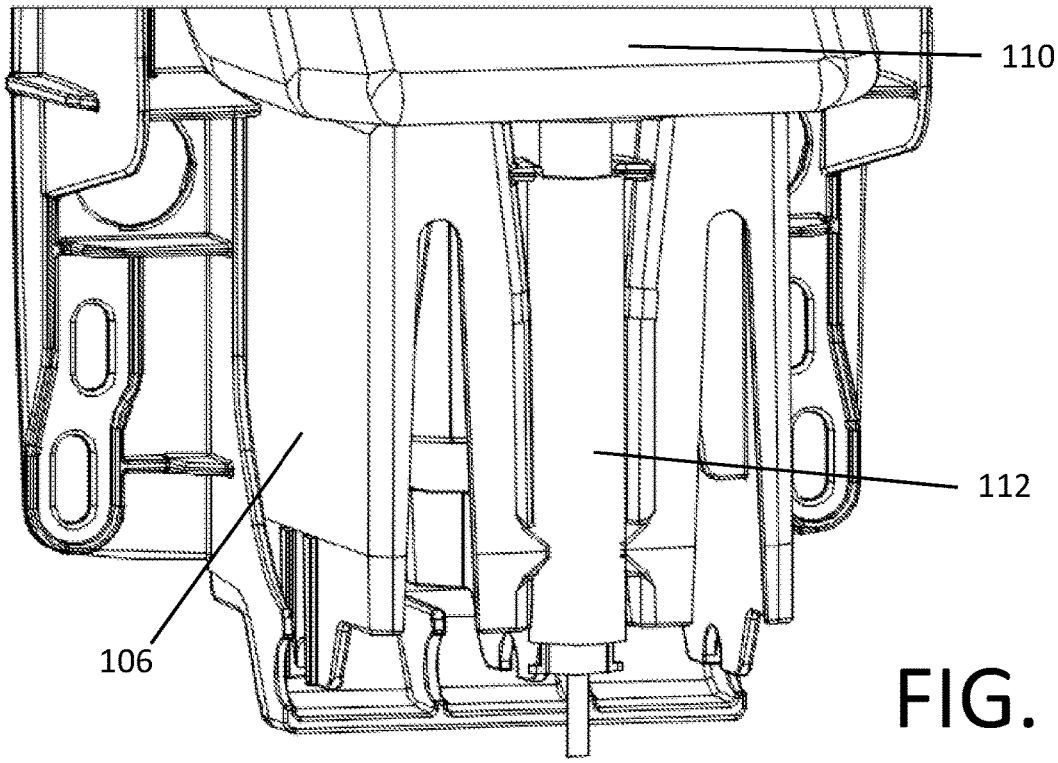
FIG. 19 is a perspective view of a portion of a wall plate and container insert for a dispenser for soap and sanitizer according to certain embodiments.
Figure 20:
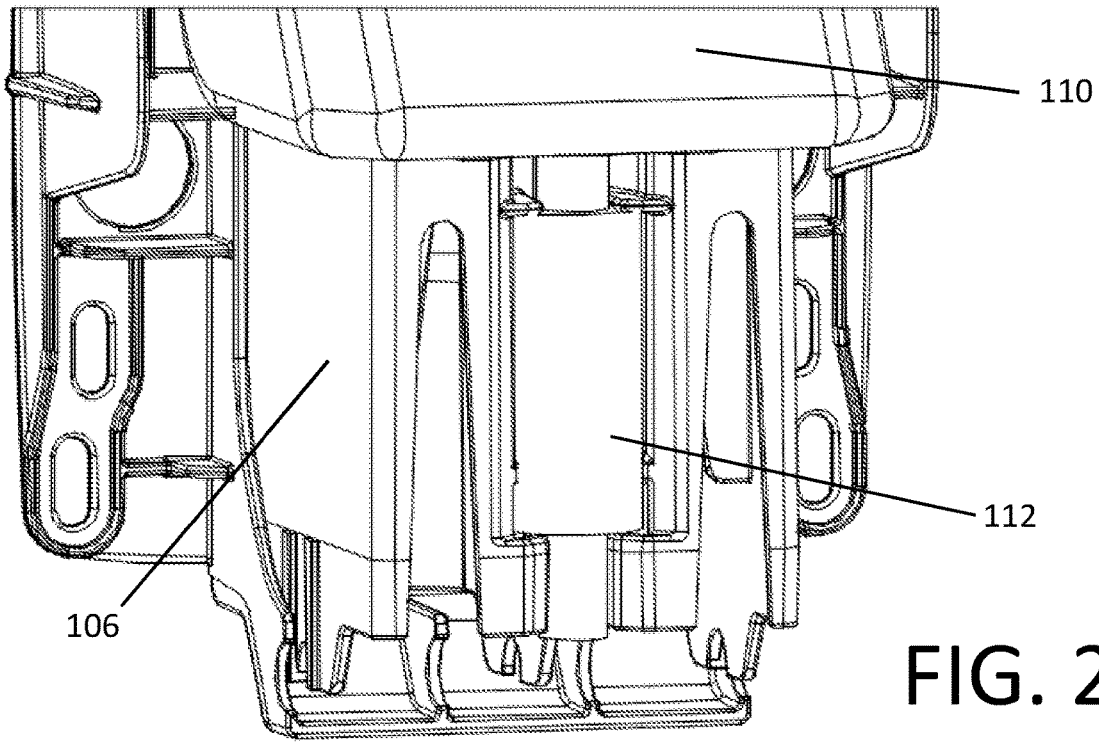
FIG. 20 is a perspective view of a portion of a wall plate and container insert for a dispenser for soap and sanitizer according to certain embodiments.

Referring to FIGS. 17-18, details of the container insert 106 will now be discussed. The insert 106 is two-sided. This means that each side of the insert 106 is configured to accept a different configuration of container and pump. A first side of the insert defines a first configuration of container receiving feature 154. A second side of the insert, opposite the first, defines a second configuration of container and pump receiving feature 156 that is different than the first configuration.

Figure 10:
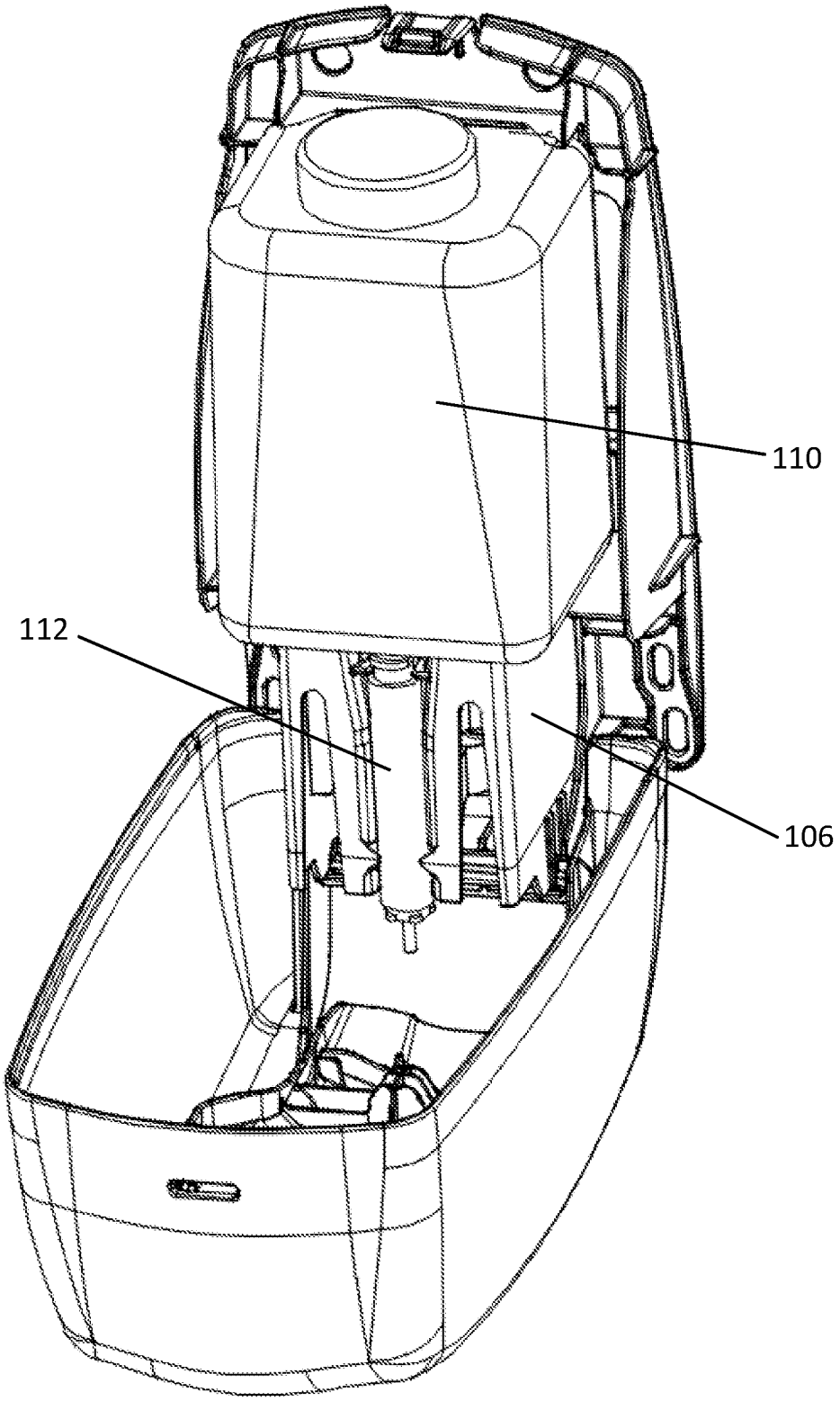
FIG. 10 is a perspective view of a dispenser for soap and sanitizer with the cover pivoted to an open position according to certain embodiments.

In the particular example depicted, the first receiving feature 154 is configured receive an 800 mL bag-type container and its associated pump. This is shown with the bag-type container 110 and pump in FIGS. 8 and 19. This configuration also can receive a refillable 700 mL bottle as depicted in FIG. 10. The second receiving feature 156 is configured receive a 1000 mL bag-type container and its associated pump. This is shown with the bag-type container 110 and pump in FIGS. 9 and 20.

In each receiving feature configuration 154, 156 of the insert 106, the shape of the channel 158 in the insert 106, as well as placement of the ribs 160 and detents 162 are varied to correctly engage the particular type of container and its pump.

As shown in FIGS. 17-18, text can be provided to the insert 106 that is read properly by the user when the insert 106 is installed for a given type of container.

Rotating the insert 106 about the vertical axis by 180 degrees allows a single container insert 106 to accommodate two or more different types of container configurations within the same dispenser 100. Additional inserts can be provided to accommodate even further different configurations and/or sizes of the containers without requiring any modification to the other dispenser components.

The "keyed" features on some pumps of containers prevent users from using other brand soap/sanitizer containers in a particular dispenser. This locks the user into a particular supplier. The present invention overcomes this deficiency because the insert 106 can be configured to accept specific "keyed" features of various pumps and containers. The user then only needs to place the correct insert into the dispenser to adapt the dispenser to a given container and pump configuration.

In use, the back plate 102 of the dispenser 100 is fastened to the wall with mechanical fasteners or double-sided tape. The dispenser cover 104 is pivoted open by pressing downward on the engagement lip 116. The correct insert 106 for the desired container 110 is secured to the back plate 102 in the correct orientation. Then the container 110 is mated to the insert 106 with the pump in the channel 158 of the insert 106. The cover 104 is then pivoted closed until the engagement lip 116 engages the corresponding slot 118 in the cover 104. The user can then press the lever 108 to manually actuate and release a quantity of soap or sanitizer from the dispenser 100.

A different type of container 110 can be disposed in the dispenser by pivoting the cover 104 open and changing the insert 106 or its orientation to an appropriately configured insert for the particular container 110. The appropriate insert 106 is secured in place in the correct orientation and then the container 110 is mated with the insert. The cover 104 is secured closed and the dispenser 100 is ready to dispense soap or sanitizer from the container.

Other features and aspects of the invention can be appreciated from the depictions in the figures, even if not described in writing herein.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. A dispenser for dispensing soap or sanitizer, comprising:

a back plate; and a container insert removably securable to the back plate; wherein the container insert comprises a first side defining a first container receiving feature into which a container can be received when the container insert is engaged to the back plate in a first orientation, and a second side, opposite the first side, defining a second container receiving feature that has a different configuration or size than the first container receiving feature into which a differently configured or sized container can be alternately received when the container insert is engaged to the back plate in a second orientation different from the first orientation.

2. The dispenser of claim 1, wherein the first container receiving feature comprises a channel defined inward from a side of the container insert with a rib projecting into the channel and the channel defining a detent.

3. The dispenser of claim 2, further comprising the container, wherein the container includes a pump portion and a main body portion, wherein the pump portion is disposed in the channel of the container insert.

4. The dispenser of claim 1, wherein the back plate defines a plurality of apertures.

5. The dispenser of claim 1, wherein the back plate includes a pair of spaced-apart side walls that project forward from a plane of the back plate, and wherein each of the spaced-apart sidewalls define a guide rib on a lateral outward surfaces of the spaced-apart side walls.

6. The dispenser of claim 5, further comprising a removable cover, wherein each of the guide ribs tapers forwardly from the plane of the back plate so that the removable cover can be guided into a correct alignment as the removable cover is operably secured to at least one of the back plate and the container insert.

7. The dispenser of claim 1, further comprising a removable cover, wherein an upper edge of the back plate defines a flexible flange with an engagement lip that is located to engage a corresponding engagement slot in a top surface of the removable cover when the removable cover is in a closed position.

8. The dispenser of claim 1, further comprising a removable cover, further including a dispensing lever pivotally engaged with the removable cover, wherein the dispensing lever pivots with respect to the removable cover between a neutral position and a dispensing position.

9. The dispenser of claim 8, wherein the dispensing lever comprises a pair of upwardly extending arms that include inward-facing projections.

10. The dispenser of claim 9, wherein the inward-facing projections are configured to snap into corresponding receiving apertures defined on brackets projecting from an inner side of the removable cover.

11. The dispenser of claim 1, further comprising a removable cover, wherein the removable cover comprises a pivot shaft that defines a pivot axis for the removable cover, wherein the pivot shaft is secured in place between an engaging portion of the back plate and a lower engaging portion of the container insert when the container insert is mated with the back plate.

12. The dispenser of claim 1, wherein the back plate comprises:

a pair of tracks that engage respective forward edges of the container insert; and a pair of tongue members that engage grooves defined in a side of the container insert.

13. The dispenser of claim 1, wherein the back plate includes a flexible locking flap that snaps over a back edge of a top surface of the container insert when the container insert is mated with the back plate.

14. The dispenser of claim 1, wherein the first container receiving feature is configured to mate with a flexible container of a first size and with a refillable bottle, and wherein the second container receiving feature is configured to mate with a flexible container of a second size that is different than the first size.

15. A method of adapting a dispenser for soap or sanitizer to a plurality of different containers types or sizes, the method comprising:

accessing a container insert;

removing the container insert that was attached to a back plate of the dispenser in a first orientation;

attaching the container insert to the back plate in a second orientation that is different than the first orientation; and covering the back plate and container insert.

16. The method of claim 15, further comprising inserting into a channel in the container insert a pump portion of a container for containing soap or sanitizer.

17. The method of claim 15, wherein attaching the container insert to the back plate in the second orientation includes disposing a flexible locking flap of the back plate over a back edge of a top surface of the container insert.

18. A dispenser for dispensing soap or sanitizer, comprising:

a back plate; and a container insert removably securable to the back plate;

wherein the back plate comprises:

a pair of tracks that engage respective forward edges of the container insert; and a pair of tongue members that engage grooves defined in a side of the container insert.

19. The dispenser of claim 18, wherein the back plate includes a flexible locking flap that snaps over a back edge of a top surface of the container insert when the container insert is mated with the back plate.

20. The dispenser of claim 18, further comprising a removable cover, wherein the removable cover comprises a pivot shaft that defines a pivot axis for the removable cover, wherein the pivot shaft is secured in place between an engaging portion of the back plate and a lower engaging portion of the container insert when the container insert is mated with the back plate.

* * * * *